US009808661B2

(12) United States Patent
Gibaud et al.

(10) Patent No.: US 9,808,661 B2
(45) Date of Patent: Nov. 7, 2017

(54) DEVICE FOR EXTINGUISHING A FIRE

(75) Inventors: Eric Gibaud, Triel sur Seine (FR); Pierre Humbert, Ollioules (FR); Bertrand Haguenauer, La Celle Saint Cloud (FR); Alexis Huet, Longron (FR)

(73) Assignee: PYROALLIANCE, Les Mureaux (FR)

( * ) Notice: Subject to any disclaimer, the term of this patent is extended or adjusted under 35 U.S.C. 154(b) by 167 days.

(21) Appl. No.: 14/004,385

(22) PCT Filed: Mar. 6, 2012

(86) PCT No.: PCT/FR2012/050461

§ 371 (c)(1),
(2), (4) Date: Nov. 15, 2013

(87) PCT Pub. No.: WO2012/120233

PCT Pub. Date: Sep. 13, 2012

(65) Prior Publication Data

US 2014/0069667 A1 Mar. 13, 2014

(30) Foreign Application Priority Data

Mar. 10, 2011 (FR) ..... 11 51967

(51) Int. Cl.

| | |
|---|---|
| ***A62C 3/07*** | (2006.01) |
| ***A62C 13/22*** | (2006.01) |
| ***A62C 3/08*** | (2006.01) |
| ***A62C 3/10*** | (2006.01) |
| ***A62C 35/02*** | (2006.01) |

(52) U.S. Cl.

CPC ..... *A62C 13/22* (2013.01); *A62C 3/08* (2013.01); *A62C 3/10* (2013.01); *A62C 35/023* (2013.01)

(58) Field of Classification Search

CPC ..... A62C 13/22
USPC ..... 169/62
See application file for complete search history.

(56) References Cited

U.S. PATENT DOCUMENTS

| | | | | |
|---|---|---|---|---|
| 3,388,746 | A * | 6/1968 | Lindberg | 169/56 |
| 3,902,425 | A * | 9/1975 | Kurtzemann | 102/531 |
| 4,262,749 | A * | 4/1981 | Monte | 169/62 |
| 4,319,640 | A * | 3/1982 | Brobeil | 169/28 |
| 5,582,254 | A * | 12/1996 | Pistek | 169/73 |
| 8,100,670 | B2 | 1/2012 | Bodart et al. | |
| 8,844,774 | B2 * | 9/2014 | Leys et al. | 222/400.7 |

(Continued)

FOREIGN PATENT DOCUMENTS

| | | |
|---|---|---|
| EP | 1782861 | 5/2007 |
| FR | 2905454 | 3/2008 |
| FR | 2936715 | 4/2010 |

(Continued)

*Primary Examiner* — Christopher Kim
*Assistant Examiner* — Adam J Rogers
(74) *Attorney, Agent, or Firm* — Hamre, Schumann, Mueller & Larson, P.C.

(57) ABSTRACT

Extinguishing a fire by pressurizing a tank containing an extinguishing liquid. According to the invention, the tank containing the liquid is provided with an expulsion outlet at a front end, a gas generator (17) is installed at a rear end, and a diaphragm forming an inflatable bag (19) is installed inside the tank, being folded prior to triggering in a confinement space at the front of the gas generator, the outlet from the generator being associated with a deflector (47) including a rearwardly-directed ejection passage (49).

18 Claims, 2 Drawing Sheets

(56) References Cited

U.S. PATENT DOCUMENTS

| | | | | |
|---|---|---|---|---|
| 2009/0202364 | A1* | 8/2009 | Bodart et al. | 417/158 |
| 2010/0288516 | A1* | 11/2010 | Fabre | A62C 35/023 169/16 |

FOREIGN PATENT DOCUMENTS

| | | |
|---|---|---|
| WO | WO 2004/091730 | 10/2004 |
| WO | WO 2006/061539 | 6/2006 |

* cited by examiner

DEVICE FOR EXTINGUISHING A FIRE

The invention relates to the field of fire extinguisher devices that are triggered by pressurizing a tank containing an extinguishing liquid. The invention relates more particularly to a device for feeding such an extinguishing liquid so as to cause the liquid to flow in an expulsion circuit having extinguishing liquid spray elements pointing towards a source of fire.

Devices of the invention are particularly suitable for on-board use as extinguishers on variable-attitude moving bodies such as airplanes, ships, submarines, . . . . More specifically, an example of the field of application of the invention as described below relates to extinguishing an airplane jet that is on fire.

When such an incident occurs, it is desirable to be able to extinguish the fire immediately after it appears, in flight, by means of an extinguisher system that is prepositioned close to the jet, this system being a controlled system. For this purpose, proposals have been made, such as in patent FR 2 936 715, for a cylindrical liquid tank that has a sliding piston separating a chamber filled with extinguishing liquid and a chamber containing a gas generator that can be triggered. The gas under pressure pushes back the piston to expel the liquid into a circuit connected to spray means.

Also known from patents FR 2 905 454 and EP 1 782 861 is a liquid tank that, instead of including a piston, includes a deformable diaphragm that separates the chamber filled with liquid from the chamber containing the gas generator. That type of device is advantageous since the inside of the tank does not need to be accurately machined in order to receive a sliding piston in leaktight manner. Nevertheless, in that known device, the diaphragm is floatingly mounted inside the tank and is attached to the inside wall and/or to the gas generator of the tank, thereby making assembly difficult. Furthermore, if the gas generator is of the pyrotechnic generator type, where the gas is the result of in situ combustion of a charge, it is necessary to control the emission of the hot gas in order to avoid it damaging the diaphragm. Thus, a deflector may be mounted around the gas outlet of the gas generator so as to limit the impact of the jet against the diaphragm. Nevertheless, EP 1 782 861 does not describe a concrete solution to that problem.

The devices of the two patents FR 2 905 454 and EP 1 782 861 are designed to operate "vertically", with the gas generator being arranged in the top portion facing the liquid ejection orifice in the bottom portion, so that gravity thus also contributes to ejecting the liquid. The direction of the gas jet coming from the generator is directed (directly or via a deflector) downwards towards the liquid ejection orifice.

Furthermore, in order to enable the quantity of liquid that is stored to be as great as possible, it is desirable for all of the elements of the device used for pushing out the liquid to be grouped together in a minimum amount of space, prior to triggering, around the gas generator that is installed at one end of the tank. For production purposes, it is also advantageous to be able to assemble all of the elements of the device required for use in pushing out the liquid in the form of a single unit that is installed in a single operation in the tank.

Finally, it is appropriate to control the way the diaphragm moves so that practically all of the liquid is indeed expelled, in particular when the attitude (orientation) of the tank is capable of varying.

The invention makes it possible to achieve all of these objects.

More particularly, the invention mainly comprises a device for feeding a fire extinguishing liquid to an expulsion circuit for said liquid, the device comprising:

- a tank containing the liquid and provided with an expulsion outlet at a front end thereof;
- a gas generator installed inside the tank at a rear end thereof; and
- a diaphragm installed inside the tank to push back the liquid towards said expulsion outlet under drive from the gas given off by said gas generator;

the device being characterized in that said diaphragm forms an inflatable bag connected in gastight manner to the gas outlet of said gas generator, said bag being folded prior to triggering of said gas generator in a confinement space defined by a cover and located inside said tank at the front of the gas generator, and in that said gas outlet is associated with a deflector comprising a generally annular ejection passage that is directed rearwards.

it should be observed that the terms "front" and "rear" should be considered with reference to the direction in which the liquid is expelled. Thus, the gas generator is necessarily at the rear of the tank and the expulsion outlet is at the front of that tank.

For example, said gas generator is enclosed in a rigid confinement enclosure comprising a base fastened to the tank and a lid provided with at least one ring of exhaust holes, said deflector comprising an annular part fastened to said lid and provided with a rear skirt surrounding said ring of holes to define said rearwardly-pointing ejection passage.

Advantageously, said gas generator is a pyrotechnic gas generator emitting combustion gas, e.g. as described in patent FR 2 905 454.

The provision of a deflector as defined above has the effect of causing the bag to begin to inflate by progressing rearwards and consequently initially moving away the liquid that is situated at the rear of the tank, i.e. all around the gas generator. This ensures that a certain quantity of liquid does not remain held captive at the rear of the tank by the bag itself as it deploys.

In an embodiment, the opening of said bag is fastened to the outside surface of the lid along a junction line situated between the base and the ejection passage. Thus, the bag and the gas generator form a single subassembly in the tank, prior to triggering.

According to an advantageous characteristic, said gas generator and said bag are enclosed, prior to triggering, in an above-mentioned cover with a breakable wall that is connected to said base in order to define said confinement space.

According to another advantageous characteristic, said cover is a thin casing advantageously having incisions encouraging it to splay open rearwards like the corolla of a flower.

Thus, the breaking and the deformation of the cover contributes to better expulsion of the liquid situated at the rear of the tank.

This cover may be made of thin metal or of a flexible material such as an elastomer. Under such circumstances, it may include an outer protective coating of metal film. It may be welded to the outside wall of the gas generator.

In certain applications where available space is limited, including in the above-mentioned application, it is desirable for the tank to comprise a generally cylindrical body and fastener means suitable for positioning said body approximately horizontally.

In addition, the liquid does not fill all of the space available inside the tank in order to be able to accommodate expansion of the liquid over a range of operating temperatures. Air therefore remains above the liquid inside the tank that is arranged approximately horizontally.

Under such circumstances, and advantageously, said gas generator is fastened to a first end wall of the tank in an axial direction relative to said cylindrical body, and said expulsion outlet is defined in the bottom portion of said cylindrical body, in the vicinity of an opposite second end wall of the tank.

Independently of this aspect, it is advantageous for the inflatable bag to have at least two compartments separated by a flow constriction system enabling the compartment closest to said ejection passage to be inflated on a priority basis.

Vents of calibrated diameter may be provided to pass gas from one compartment to another. They may optionally have different diameters so as to encourage the bag to inflate sideways, initially at a distance from the expulsion outlet, so as to enable the bag to push the liquid out towards this outlet better, while becoming deployed relatively smoothly within the tank. This avoids the bag deploying like a flare which would make it considerably less effective.

For the same purpose, the device may be characterized in that the two compartments in the folded state are held one against the other by a breakable connection extending along a non-closed line and situated essentially in the bottom portion of the tank.

This breakable connection may merely be stitching between the compartments of the bag.

The above-described device is well adapted to using a high density extinguishing liquid having high extinguishing power while also evaporating without constituting a danger for the ozone layer. By way of example, such a liquid may be a non-flammable hydrofluoroether. By way of example, one such liquid is 2-trifluoromethyl-3-ethoxydodecafluorohexane sold under the name HFE 7500 NOVEC by the supplier 3M.

The invention also provides any extinguisher or extinguishing system making use of the above-defined device. More generally, the invention also provides a variable-attitude moving body making use of such a device. More particularly, the invention also provides an aircraft provided with at least one extinguisher using such a device.

The invention can be better understood and other advantages thereof appear more clearly in the light of the following description of a device for feeding a fire extinguishing liquid in accordance with the principle of the invention, given purely by way of example and made with reference to the accompanying drawings, in which.

Figure 1:
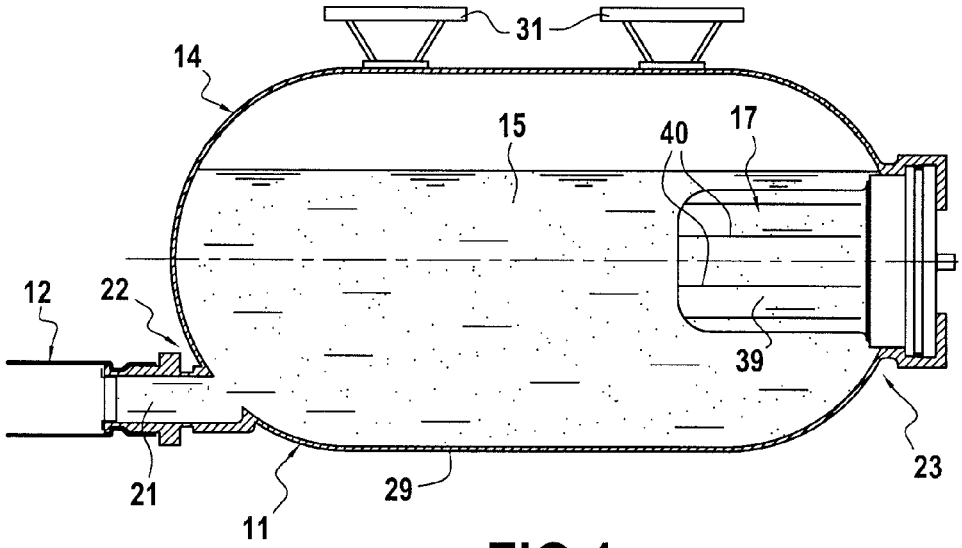
FIG. 1 is a general diagrammatic view in elevation and in section of a device in accordance with the invention, before triggering.

With reference to the drawings, there can be seen a feeder device 11 for feeding a fire extinguishing liquid, which device is connected to an expulsion circuit 12 for the extinguishing liquid. This circuit is connected to one or more spray heads directed towards a subassembly that might constitute the source of fire, such as for example an airplane jet.

The device 11 comprises a tank 14 containing the extinguishing liquid 15, a gas generator 17 for delivering gas under pressure, the generator being installed inside the tank, and a bag-shaped diaphragm 19 installed inside the tank to push out the liquid 15 under drive from the gas emitted by the gas generator towards an expulsion outlet 21 of the tank that is connected to the circuit 12. More precisely, the expulsion outlet 21 is arranged at a front end of the tank while the gas generator is installed at a rear end of the same type.

Figure 2:
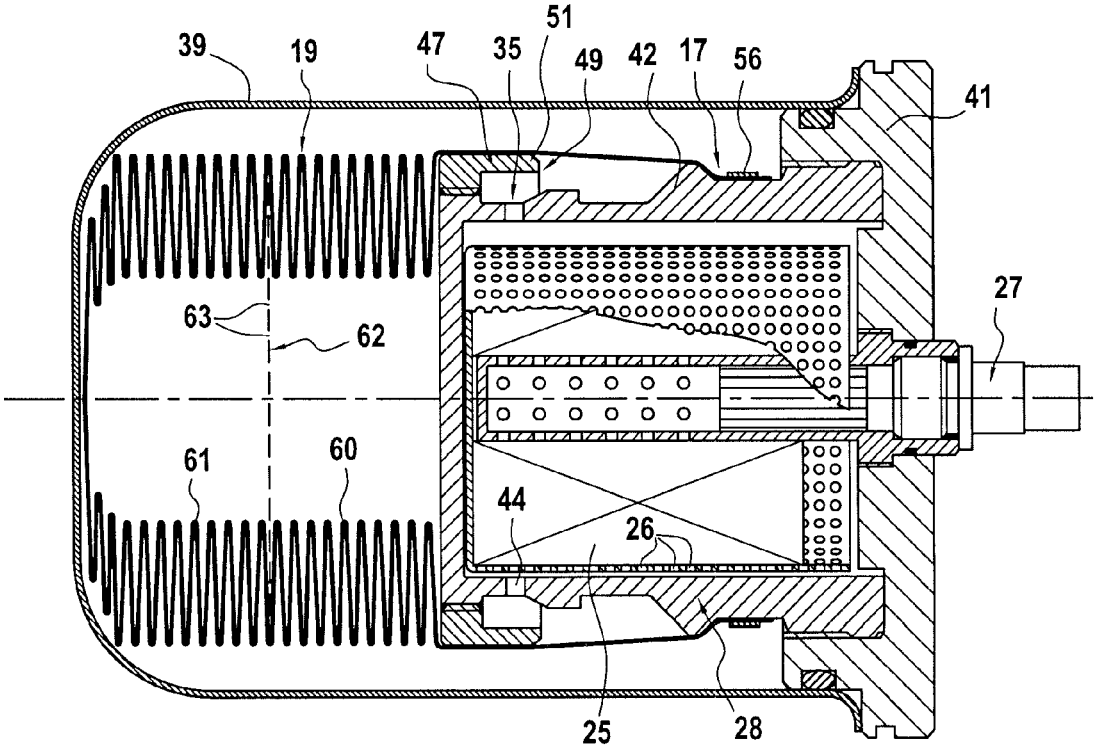
FIG. 2 is a diagrammatic detail view of the liquid expulsion system, before triggering.
Figure 3:
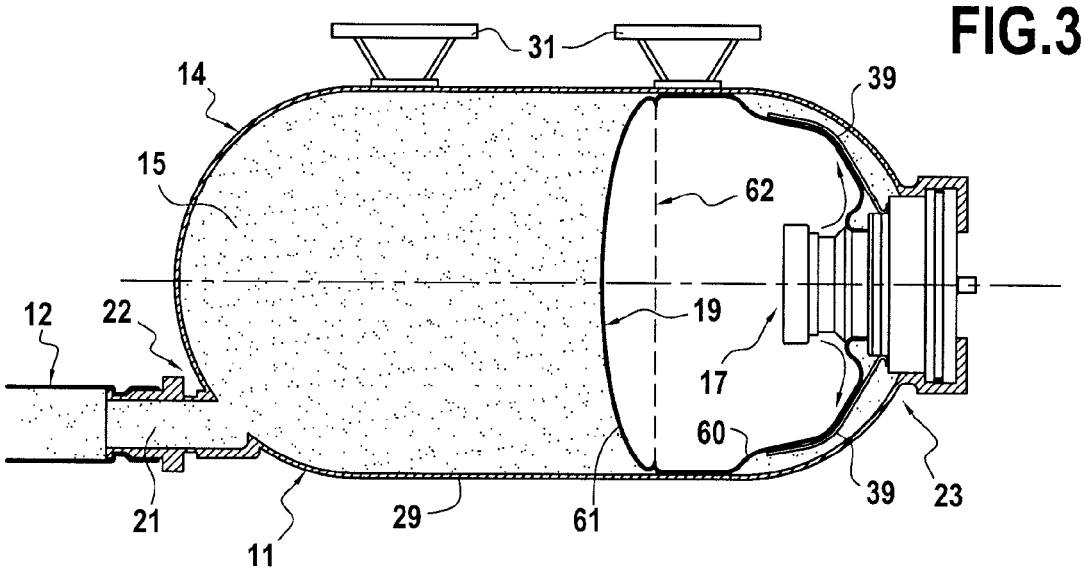
FIG. 3 is a view analogous to FIG. 1, showing the operation at the beginning of a liquid-expulsion stage.
Figure 4:
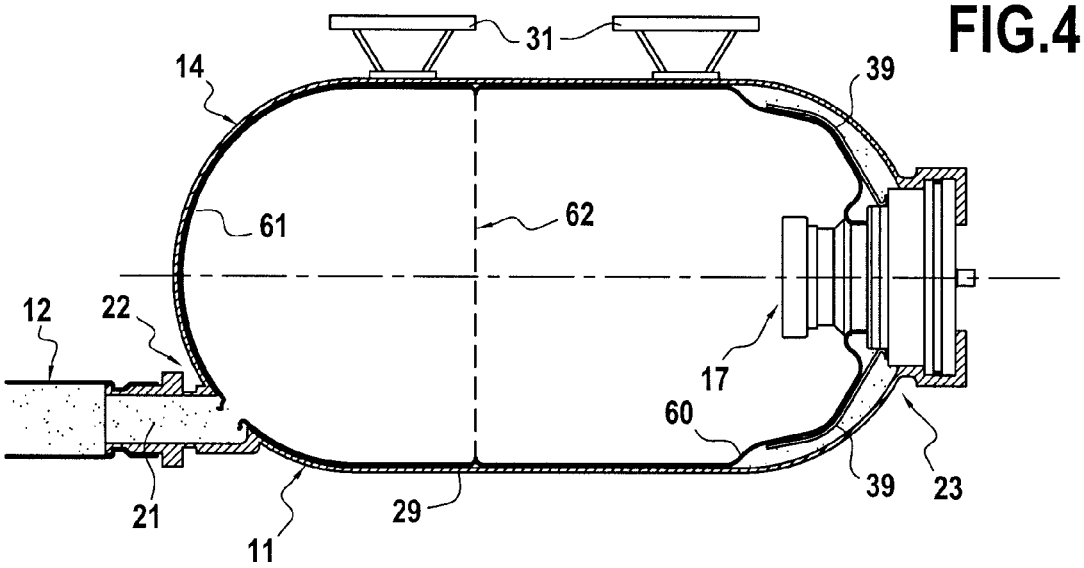
FIG. 4 is a view analogous to FIG. 3 showing the state of the system at the end of this expulsion stage.

In the example described, the gas generator 17 is a pyrotechnic gas generator that emits a hot combustion gas on being triggered. This type of generator that is triggered electrically is conventional and is not described in detail. In FIG. 2, it can be seen that it is constituted essentially by a charge of solid propellant 25 enclosed inside a perforated metal casing 26, itself enclosed in a rigid confinement enclosure 28. Ignition of the charge is triggered electrically via an electrical connector 27.

As shown, the tank comprises a body 29 that is generally cylindrical in shape and that is extended by two hemispherical end walls 22 and 23. Fastener means 31 are welded to the outside of the tank. In FIG. 1, these fastener means are arranged so that the tank is positioned approximately horizontally. Under such conditions, and as shown, the gas generator is fastened to a first end wall 23 (the rear end wall) of the tank in a direction that is axial relative to the cylindrical body. The expulsion outlet 21 is defined at the bottom portion of an opposite second end wall 22 (the front end wall) of the tank. The extinguishing liquid occupies the major fraction of the space available inside the tank, but it does not fill it completely in order to be able to accommodate potential expansion of the liquid as a function of temperature. Consequently, the top portion of the tank contains air. The liquid surface lies above the gas generator so that the gas generator is completely immersed inside the extinguishing liquid before it is triggered.

The bag 19 is inflatable. It is connected in gastight manner to a gas outlet 35 of said gas generator. Before the gas generator 17 is triggered, the bag 19 is folded in a confinement space defined inside the tank 14 in front of the gas generator 17.

More precisely, the gas generator 17 and the bag 19 are enclosed prior to triggering inside a cover 39 having a breakable wall. The cover is a thin metal casing having incisions 40 to facilitate the bag splaying out rearwards like the corolla of a flower as soon as the bag 19 begins to be inflated. An opening in the cover may be welded to the outside wall of the gas generator 17, i.e. to the edge of the base 41.

As shown, the gas generator 17 is enclosed in the rigid enclosure 28 which comprises a base 41 fastened to the tank and a lid 42 provided with a ring of exhaust holes 44.

The gas outlet 35 comprises the exhaust holes 44. It is thus defined in the side wall of the enclosure 28. This gas outlet 35 is associated with a deflector 47 co-operating with the rigid enclosure to define an ejection passage 49 that is generally annular and that points rearwards. The deflector 47 forms an annular part fastened to the lid 42. It comprises a rear skirt 51 surrounding said ring of holes 44 in order to define the rearwardly-pointing ejection passage 49. The opening in the bag 19 is fastened to the outside surface of the lid 42 via an annular collar 56 at a junction line situated between the base 41 and the ejection passage 49. The bag 17 thus begins to inflate around and behind the ejection passage 49.

In the example, the inflatable bag 19 has at least two compartments 60 and 61 separated by a flow constriction system enabling the compartment 60 that is nearer to the ejection passage 49 to inflate on a priority basis. For example, the two compartments are separated by a wall 62 having calibrated holes 63 suitable for delaying the inflation of the front compartment 61 relative to the inflation of the rear compartment 60.

Figure 5:
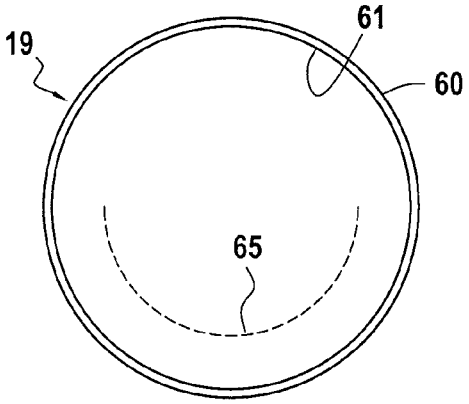
FIG. 5 is a diagrammatic detail view looking along arrow V of FIG. 2 and showing a breakable temporary junction of two compartments of the bag, prior to triggering.

According to another advantageous characteristic, the two compartments 60 and 61 while in the folded state, i.e. before the cover 39 has burst, are held against each other by a breakable connection extending along a line that is not closed and that is situated essentially in the bottom portion of the tank. As shown in FIG. 5, this breakable connection may be constituted by stitching 65, e.g. over a circular arc substantially parallel to the edge of the bag 19 in the folded state.

The function of this stitching is to encourage the rear compartment 60 of the bag to inflate initially towards the rear top portion of the tank 14 so as to push away more thoroughly the liquid situated in this zone and consequently so as to prevent a portion of the liquid remaining trapped between the inside wall of the tank and the outside wall of the rear compartment 60 of the bag 17.

After the stitching 65 has broken, inflation of the bag continues in a generally axial direction.

Operation is as follows.

After it has been installed, the device 11 is arranged substantially horizontally as shown in FIG. 1, the gas generator 17 and the inflatable bag 19 are enclosed prior to triggering inside the cover 39 having a breakable wall. The assembly projects axially into the inside of the tank 14 from the rear end of the tank. These elements are immersed in the liquid, but they are protected by the liquid-proof cover 39.

When a fire is detected, an electrical signal is applied to the ignition system of the gas generator via the electrical connector 27. The pyrotechnic charge begins combustion and starts to fill the inflatable bag, and initially to fill mainly its rear compartment 60. Because of the stitching 65, the rear compartment begins to deploy mainly upwards and rearwards while causing the cover 39 to burst into a corolla shape. The elements of this split cover become pressed against the hemispherical rear wall 23. Once the rear compartment 60 has inflated sufficiently to break the stitching, it becomes pressed against the entire hemispherical rear wall 23 of the tank and it continues to progress forwards in a generally axial direction while the front compartment 61 also begins to inflate as the combustion gas penetrates therein, while being delayed by the vent provided between said compartments.

The assembly continues to advance while pushing back the liquid towards the expulsion outlet 21 until all of the liquid has been pushed away into the circuit 12 and sprayed on the source of fire. Once the hot gas has finished deploying the inflatable bag 19, the bag is pierced in register with the internal orifice of the expulsion outlet 21, in particular, so that the liquid remaining in the circuit 12 ends up by being pushed out by the hot gas under pressure that results from the combustion.

The invention claimed is:

1. A device for feeding a fire extinguishing liquid to an expulsion circuit for the fire extinguishing liquid, the device comprising:

a tank containing the fire extinguishing liquid and provided with an expulsion outlet at a front end thereof;

a gas generator installed inside the tank at a rear end thereof, the gas generator enclosed in a rigid confinement enclosure fastened to the tank, the gas generator includes a gas outlet;

a diaphragm installed inside the tank to push back the fire extinguishing liquid towards the expulsion outlet under drive from a gas given off by the gas generator; and a deflector connected to the rigid confinement enclosure, and arranged between the rigid confinement enclosure and the diaphragm, wherein the diaphragm forms an inflatable bag connected in gastight manner to the gas outlet of the gas generator, the opening of the inflatable bag being directly fastened to the outside surface of the rigid confinement enclosure, the deflector being contained in the inflatable bag, the deflector includes an ejection passage for directing the gas given off by the gas generator rearwards of the tank and then to fill the inflatable bag, and the inflatable bag being folded prior to triggering of the gas generator in a confinement space defined by a cover and located inside the tank at a front of the gas generator.

2. The device according to claim 1, wherein the gas generator is a pyrotechnic gas generator emitting combustion gas.

3. The device according to claim 1, wherein the rigid confinement enclosure comprises a base fastened to the tank and a lid provided with a ring of exhaust holes, the deflector comprising an annular part fastened to the lid and provided with a rear skirt surrounding the ring of holes to define the rearwardly-pointing ejection passage.

4. The device according to claim 3, wherein the opening of the bag is fastened to the outside surface of the lid along a junction line situated between the base and the ejection passage.

5. The device according to claim 3, wherein the gas generator and the bag are enclosed, prior to triggering, in the above-mentioned cover, and wherein the cover has a breakable wall and is connected to the base in order to define the confinement space.

6. The device according to claim 5, wherein the cover is a thin casing having incisions encouraging it to splay open rearwards.

7. The device according to claim 5, wherein said cover is a thin metal casing.

8. The device according to claim 5, wherein the cover is made of flexible material.

9. The device according to claim 8, wherein flexible material is an elastomer.

10. The device according to claim 8, wherein the flexible material of the cover includes an outer protective metallic film coating.

11. The device according to claim 1, wherein the tank comprises a generally cylindrical body and fastener means suitable for positioning the body approximately horizontally, wherein the gas generator is fastened to a first end wall of the tank in an axial direction relative to the cylindrical body, and wherein the expulsion outlet is defined in the bottom portion of the body, in the vicinity of an opposite second end wall of the tank.

12. The device according to claim 1, wherein the inflatable bag has at least two compartments separated by a flow constriction system enabling the compartment closest to the ejection passage to be inflated on a priority basis.

13. An extinguisher comprising the device according to claim 1.

14. A variable-trim moving body comprising at least one extinguisher which includes at least one device according to claim 1.

15. An aircraft provided with at least one extinguisher comprising at least one device according to claim 1.

16. A device for feeding a fire extinguishing liquid to an expulsion circuit for the fire extinguishing liquid, the device comprising:

a tank containing the fire extinguishing liquid and provided with an expulsion outlet at a front end thereof;

a gas generator installed inside the tank at a rear end thereof; and a diaphragm installed inside the tank to push back the fire extinguishing liquid towards the expulsion outlet under drive from the gas given off by the gas generator;

wherein the diaphragm forms an inflatable bag connected in gastight manner to a gas outlet of the gas generator, the bag being folded prior to triggering of the gas generator in a confinement space defined by a cover and located inside the tank at a front of the gas generator, and wherein the gas outlet is associated with a deflector comprising a generally annular ejection passage that is directed rearwards, the tank comprises a generally cylindrical body and fastener means suitable for positioning the body approximately horizontally, the gas generator is fastened to a first end wall of the tank in an axial direction relative to the cylindrical body, the expulsion outlet is defined in the bottom portion of the body, in the vicinity of an opposite second end wall of the tank, and the two compartments in the folded state are held one against the other by a breakable connection extending along a non-closed line and situated essentially in the bottom portion of the tank.

17. The device according to claim 16, wherein the breakable connection is stitching.

18. The device according to claim 16, wherein the non-closed line is a circular arc substantially parallel with an edge of the bag in the folded state.

* * * * *